United States Patent [19]

Burkholder, Jr.

[11] 3,959,569

[45] May 25, 1976

[54] PREPARATION OF WATER-ABSORBENT ARTICLES

[75] Inventor: Nelson D. Burkholder, Jr., Midland, Mich.

[73] Assignee: The Dow Chemical Company, Midland, Mich.

[22] Filed: Aug. 2, 1974

[21] Appl. No.: 494,267

Related U.S. Application Data

[63] Continuation of Ser. No. 58,712, July 27, 1970, abandoned.

[52] U.S. Cl. ..... 428/475; 427/195; 427/324; 427/335; 427/377; 428/507

[51] Int. Cl.[2] ..... B44D 1/44; B44D 1/22

[58] Field of Search ..... 117/16, 33, 56, 62, 117/63, 161 P, 21; 260/89.7 R; 427/195, 335, 377, 324; 428/495,507

[56] References Cited

UNITED STATES PATENTS

| | | | |
|---|---|---|---|
| 3,297,476 | 1/1967 | Kane | 117/132 |
| 3,476,581 | 11/1969 | Weitzel et al. | 117/62 |
| 3,669,792 | 6/1972 | Mitsukawa et al. | 156/249 |
| 3,676,171 | 7/1972 | Spiller et al. | 117/17 |
| 3,676,172 | 7/1972 | Van Dyk et al. | 117/21 |
| 3,758,641 | 9/1973 | Zweigle | 260/874 |

*Primary Examiner*—Michael R. Lusignan
*Attorney, Agent, or Firm*—Glywnn R. Baker

[57] ABSTRACT

Water-absorbent articles are prepared by contacting a fibrous material with a dry granular or powdered water-swellable gel and steaming the mixture. Adherence of the gel is improved by pretreatment of the fibrous base with a cationic polymer such as polyethylenimine. Fabrics or fluffs coated with particulate gels such as crosslinked partially hydrolyzed polyacrylamide are useful in various applications where it is desirable to hold or absorb an aqueous fluid in a particular location.

11 Claims, No Drawings

PREPARATION OF WATER-ABSORBENT ARTICLES

This is a continuation, of application Ser. No. 58,712 filed July 27, 1970, now abandoned.

BACKGROUND OF THE INVENTION

This invention relates to a process for sticking a water-swellable polymeric gel to a fibrous material and to the product of such process. It relates particularly to a woven or nonwoven fabric, cellulosic fluff, or wadding coated with a substantial quantity of a dry, particulate gel such as a cross-linked, water-swellable, partially hydrolyzed polyacrylamide and to the processes for making and using such absorbent articles.

Bandages and absorbent pads containing powdered or granular water-absorbent materials such as polyoxyethylene sorbitol, carboxymethylcellulose, sodium alginate, or other such substance sprinkled or interspersed between layers of cotton, absorbent paper, or other cellulosic material are known and have been used to absorb and hold body fluids. Although such articles provide a useful means whereby substantially larger quantities of moisture can be absorbed than is possible with the untreated fabrics, it is often difficult to keep the absorbent solid in place once it has been more or less evenly dispersed.

SUMMARY OF THE INVENTION

It has now been found that highly water-absorbent articles for various water-absorbing or water-holding purposes avoid the disadvantages of the prior art combinations when they are prepared by contacting a fibrous material with a more or less finely granulated, dry, water-swellable but essentially water-insoluble polymer and contacting the mixture with steam until the surface of the gel particles becomes sticky, thereby firmly bonding the gel particles to the fibrous support. A relatively adherent coating of substantially dry, particulate gel on the fibrous support is obtained, producing a composite which has stable uniformity to the extent required and which has capacity for absorbing and holding a substantial quantity of water, a body fluid, or other aqueous liquid. Preferably, the polymer is a cross-linked, partially hydrolyzed polymer of acrylamide or a corresponding acrylamide-acrylate copolymer. The fibrous underlayer can first be treated with a water-soluble cationic polymer such as polyethylenimine, a polyalkylenepolyamine, or a cationic derivative of polyacrylamide to increase adherence of the gel.

DETAILED DESCRIPTION

The invention is applicable in different ways to a number of varied uses. For example, the granular gel may be spread on a woven or unwoven fabric such as cotton cloth, rayon, wool, surgical gauze, or paper. Multilayer laminates can be made with two or more layers of the coated fabric base. Alternatively, the gel can be mixed with loose fibers of cellulose, asbestos, or other such material to make a composite fluff or wadding which can be used between two cover sheets of paper or cloth to make a water-absorbent article of some bulk having a considerable capacity for absorbing water.

Polymers useful in the invention include cross-linked polymers and cross-linked copolymers of acrylamide, acrylates such as acrylic acid-acrylamide and acrylic acid-ethylene copolymers, and polymers and copolymers of vinyloxazolidinone, vinylpyrrolidinone, methacrylate salts, and salts of styrenesulfonates such as sodium polystyrenesulfonate and sodium polyvinyltoluenesulfonate, also styrene-maleic anhydride copolymers lightly cross-linked by reaction with a small amount of a difunctional compound such as a glycol, an alkylenediamine polyalkylenepolyamine, or a divinyl monomer and in which the acid anhydride groups have been hydrolyzed and neutralized by reaction with an aqueous base, such polymers having the properties of being water-swellable but substantially insoluble in water. Particularly valuable in the present invention are cross-linked polymers of acrylamide made by a process such as that described by Walker et al., U.S. Pat. 3,247,171. For example, a solution of 2–20 percent acrylamide in water is polymerized in the absence of oxygen in the presence of 0.002–0.5 mole percent of a diene cross-linking monomer such as methylenebisacrylamide at 25°–90°C. using a water-dispersible free radical-initiating catalyst for causing ethylenic polymerization. The resulting polymer is then preferably hydrolyzed by treatment with sufficient alkali metal hydroxide to convert up to about 50 percent, preferably 10–40 percent, of the carboxamide groups to alkali carboxylate. The hydrolyzed polymer is essentially composed of units having the formula

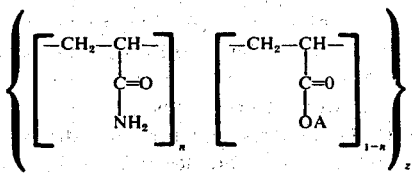

where A is an alkali metal ion such as sodium or potassium, $n$ is 0.5 to about 0.9, $l$–$n$ defines the extent of hydrolysis, and z is the number of mer units between cross-links.

A polymer of similar molecular structure is made by copolymerizing acrylamide and acrylic acid or its alkali metal salt in the presence of a cross-linking monomer such as N,N′-methylenebisacrylamide in the manner described. Such a polymer may have a somewhat higher proportion of carboxylate groups than shown by the above formula, for example, where $n = 0.2$–$0.9$.

The powdered or more coarsely granular dry polymer can be sprinkled on a cloth or paper sheet or mixed with loose cellulosic fibers by any convenient procedure. The combination of fibrous support and particulate gel is then exposed to steam for a time sufficient to soften the surface of the dry gel particles and make them sticky enough to adhere to the support. The steam treatment is ordinarily at substantially atmospheric pressure. The combination of sticky gel and fibrous support can be subjected to pressure after or during the steam treatment in order to force the gel particles against the fibers of the support material and thereby obtain better and more complete adhesion. Running the steamed material between two rolls is one way of thus promoting adhesion of the gel. Alternatively, the gel-fiber composite may be steamed while it is confined in a suitable press. However, for some applications, the use of pressure in combination with the steaming process may produce an undesirably stiff article and so would be undesirable.

Improved adherence of the gel to the base in the finished product may be obtained when the base is first treated with a cationic water-soluble polymer such as polyethylenimine, a polyalkylenepolyamine, or a cationic derivative of polyacrylamide such as that obtained by reacting a partially hydrolyzed polyacrylamide with formaldehyde and dimethylamine to produce a Mannich base product wherein a substantial portion of the carboxamide groups have dimethylaminomethyl substituents. Of particular value for promoting gel adhesion to the fibrous base are water-soluble, essentially linear polymers of acrylamide in which at least five mole percent of the combined monomer units are N-(dialkylaminomethyl)acrylamide moieties and the remaining units correspond to monoethylenically unsaturated monomers copolymerizable therewith, at least about half of the monomers being hydrophilic to insure water solubility of the finished copolymer. Such polymers are conveniently prepared by reacting polycrylamide with sufficient formaldehyde and a dialkylamine such as diethylamine or dimethylamine to convert about 5–35 percent of the carboxamide groups to N-(dimethylaminoethyl)carboxamide group. Ordinarily, a small proportion of carboxylate groups is also present in the polymer structure. The aminomethylation of polymeric amides is described in detail by Suen et al., Ind. Eng. Chem. 49 2132 (1956) and by Grimm et al., U.S. Pat. No. 2,328,901. Other such cationic polymeric substances such as polyaminoalkyl acrylates and cationic starches obtained by reacting amines with modified starches can also be used in the same way to pretreat the fibrous base for better gel adhesion. Dipping the fabric or other fibrous base in a dilute aqueous solution of the cationic polymer and drying prior to coating with the gel and steaming is a convenient means of treatment. While any significant quantity of cationic polymer will be advantageous in the process, preferably about 0.1–5 percent by weight cationic polymer is applied to the fibrous base.

The invention has various modes of operation and use. A partially hydrolyzed, lightly cross-linked polyacrylamide gel can be made by carrying out the polymerization of acrylamide in the presence of aqueous sodium carbonate as described by Proffitt, U.S. Pat. No. 3,022,279. The water-swellable gel can be produced in bead form by the inverse suspension polymerization of water-soluble monomer as described by Friedrich et al., U.S. Pat. No. 2,982,749 and the water-swollen beads then applied to a fabric backing. A combination of these or other known procedures as described above can be employed in the practice of the present invention for various applications.

Many uses are apparent for such absorbent articles. For example, absorbent tissue with powdered gel impressed into its surface or even within its structure to some extent can be used as a facial tissue with enhanced capacity for absorbed moisture. The same kind of composition can be used as the absorbing part of a disposable diaper. For such use, a powdered gel stuck to a cellulosic fluff or shredded tissue is preferred for rapid absorption. In such an application, dry polymer particles could be fed into the mill as the fluff was being made, or the powdered polymer could be sprinkled on a web of fluff after milling. In either case, steaming of the polymer-fluff mixture sticks the polymer particles to the fluff. A quilted construction with the absorbent material contained between two retaining sheets of porous fabric is appropriate. Similar constructions can be used effectively as high liquid capacity absorbent pads, bandages, and the like. Tampons and compresses are other examples of articles in which the invention can be useful.

EXAMPLE 1

A solution obtained by mixing 1480 ml. of 16.2% aqueous acrylamide, 520 ml. of water, and 4.8 g. of Miranol J2M (a 35% aqueous solution of 1-[2-(carboxymethoxy)ethyl]-1-(carboxymethyl)-2-heptyl-2-imidazolinium hydroxide, disodium salt) was adjusted to pH 6.2 by addition of KOH and purged with nitrogen at 40°C. for about a half hour. To the solution was added 0.36 g. of N,N'-methylenebisacrylamide, 0.48 g. of Versenex 80 (sodium salt of diethylenetriaminepentaacetic acid), 0.17 g. of tertiary butyl hydroperoxide, and 0.05 g. of $K_2S_2O_8$ and the mixture was heated at 40°–57°C. for 17 minutes, then put in an oven at 80°C. for 1.5 hours to finish the polymerization. A second batch of gelled polymer was prepared in the same way and the two products were mixed together. About 30 mole percent of 10% aqueous KOH (based on acrylamide) was added to the stirred gel and the mixture was left in an oven overnight at 80°C. The hydrolysis amounted to about 30.5% based on carboxylate group analysis.

A portion of the gel is dried and ground to a fine powder. The powder is mixed with about an equal weight of cotton linters and steam is passed through the mixture while it is tumbled for about five minutes. Upon drying the slightly damp product, it is found to be a mass of cotton fibers more or less uniformly coated with relatively adherent particles of gel. The composite article absorbs about 20–30 times its weight of water.

EXAMPLE 2

To 1520 ml. of 15.8% aqueous acrylamide (240 g. of acrylamide) there was added 4.8 g. of Miranol J2M and the solution was purged with nitrogen at 40°C. for one-half hour. At this time, 0.48 g. of Versenex 80, 0.17 g. of tertiary butyl hydroperoxide, and 0.05 g. of potassium persulfate were added and the solution was stirred and heated to 48°C., whereupon it became quite viscous some five minutes after the addition. A quantity of 0.48 g. of N,N'-methylenebisacrylamide was stirred into the polymerizing mixture, causing a further increase in viscosity to the point where stirring became very difficult after nine minutes. The polymerized mixture was then put in an oven at 85°C. for one hour, cooled, and put through a food chopper to break up the polymer gel. Aqueous 10% KOH containing 57 g. of KOH was stirred into the gel and the mixture was left in an oven at 85°C. overnight. In the resulting hydrolyzed gel, about 34% of the original amide groups had been converted to carboxylate radicals. The dried material, 94.2% solids, absorbed 794 g. of distilled water per gram.

The powdered dry gel is sprinkled evenly over facial tissues in a quantity about half the weight of the tissue. Several such coated tissues are piled one on top of the other with a plain tissue on the top and the pile is subjected to slight pressure from top and bottom while steam is passed through the layers. After steaming and drying, substantially all of the gel is found to have been stuck to the contacting layers of tissue and the pile forms a unitary article capable of absorbing several hundred times its weight of water.

EXAMPLE 3

The procedure of Example 2 is repeated using tissues previously wet with an aqueous solution of polyacrylamide of about 1.5 million average molecular weight which had been reacted with dimethylamine and formaldehyde to make a polymer product containing about 35–50% by weight of N-(dimethylaminomethyl-)acrylamide units in its molecular structure. The impregnated tissues are dried before addition of the powdered gel and steaming. Significantly increased adhesion of the gel particles to the tissue is obtained as a result of the cationic polymer pretreatment.

EXAMPLES 4–8

A series of experiments was carried out in which dry powdered water-swellable polymer was sprinkled over half a sheet of facial tissue, the sheet was folded over to cover the polymer-covered half, and the resulting polymer-tissue sandwich was steamed for ten seconds. The steamed sandwich was allowed to dry, then it was picked up at a corner of the folded edge and shaken lightly over a black surface to see how much of the polymer would be released. In each case, as shown below, little if any polymer failed to stick to the steamed tissue.

| Polymer | Quantity of Polymer Released |
|---|---|
| Polyacrylamide[1] cross-linked with 1700 ppm MBA[2] | trace |
| Na Polyacrylate cross-linked with 1000 ppm MBA[2] | trace |
| Polyvinylpyrrolidone cross-linked with 0.7% divinyl ether of diethylene glycol | trace |
| Acrylamide-N-Vinylpyrrolidone (3:2) cross-linked with 0.7% based on monomers of MBA | small |
| Maleic Anhydride-Styrene (1:1)[3] cross-linked with 0.001 mole based on maleic anhydride of triethylene-tetramine | small |

[1]The polyacrylamide contained about 5% carboxylate groups.
[2]N,N′-methylenebis(acrylamide)
[3]Polymer had been treated with aqueous NaOH to hydrolyze and neutralize the acid anhydride groups.

With each polymer, an unsteamed control sandwich released all or essentially all of the powdered polymer upon shaking.

Results similar to those shown in the foregoing examples are obtained when another water-insoluble but water-swellable polymer as previously described is substituted for the polymers of the examples. Similarly, cloths, nonwoven fabrics, and fibers other than cellulosic tissues or fibers are used as the fibrous support for the polymer gel in the process of the invention to obtain analogous results. A particular example of such a polymer is a water-soluble copolymer of acrylic acid (or sodium salt thereof) and ethylene which has been made substantially water-insoluble but still water-swellable by cross-linking such a suitable difunctional monomer, for example, N,N′-methylenebisacrylamide.

I claim:

1. A process for preparing water-absorbent articles consisting essentially of:

a. distributing a dry granular/powdered water-swellable cross-linked polymeric gel onto/into a fibrous material, and b. subjecting the so-contained fibrous material to the action of steam for a period of time and at a pressure and temperature to soften at least the surface of the gel, thereby to cause the gel to become sticky and to firmly adhere to the fibrous material.

2. The process of claim 1 wherein the polymer is a cross-linked polyacrylamide.

3. The process of claim 2 wherein the polymer gel is a cross-linked polyacrylamide prepared by aqueous ethylenic polymerization in the presence of 0.002–0.5 mole percent of a diene cross-linking monomer and subsequently partially hydrolyzed with alkali metal hydroxide to convert 10–50 percent of the carboxamide groups in the polyacrylamide to carboxylate groups.

4. The process of claim 1 wherein the polymer gel is a cross-linked polyacrylate.

5. The process of claim 1 wherein the polymer gel is a cross-linked polyvinylpyrrolidone.

6. The process of claim 1 wherein the polymer gel is a cross-linked acrylamide-N-vinylpyrrolidone copolymer.

7. The process of claim 1 wherein the polymer gel is a cross-linked, base-neutralized styrene-maleic anhydride copolymer.

8. The process of claim 1 wherein the fibrous support is impregnated with 0.1–5% by weight of a water-soluble, cationic polymer prior to application of the steam.

9. The process of claim 8 wherein the cationic polymer is a polyacrylamide wherein 5–35% of the carboxamide groups have been converted to N-(dimethylaminomethyl)carboxamide groups.

10. The product of the process of claim 1.

11. The product of the process of claim 2 wherein the fibrous support is a cellulosic material.

* * * * *